United States Patent [19]

Radaelli

[11] Patent Number: 4,492,201

[45] Date of Patent: Jan. 8, 1985

[54] PETROL INJECTOR PROTECTION SHEATH

[75] Inventor: Dario Radaelli, Legnano, Italy

[73] Assignee: Alfa Romeo Auto S.p.A., Naples, Italy

[21] Appl. No.: 491,704

[22] Filed: May 5, 1983

[30] Foreign Application Priority Data

May 17, 1982 [IT] Italy ..... 21314 A/82

[51] Int. Cl.[3] ..... F02M 55/00; F02M 61/14; F02M 55/02

[52] U.S. Cl. ..... 123/470; 123/469

[58] Field of Search ..... 123/470, 469, 468, 471; 239/533.11; 292/80

[56] References Cited

U.S. PATENT DOCUMENTS

| | | | |
|---|---|---|---|
| 3,841,727 | 10/1974 | Schäfer | 123/470 |
| 3,993,030 | 11/1976 | Jaulmes | 123/470 |
| 4,143,625 | 3/1979 | Kulke | 123/470 |
| 4,201,172 | 5/1980 | Jäggle et al. | 123/470 |
| 4,240,385 | 12/1980 | Kulke | 123/470 |
| 4,294,215 | 10/1981 | Hans et al. | 123/470 |
| 4,307,693 | 12/1981 | Glöckler et al. | 123/470 |
| 4,327,600 | 5/1982 | Sauer et al. | 123/469 |

FOREIGN PATENT DOCUMENTS

| | | | |
|---|---|---|---|
| 2208646 | 8/1973 | Fed. Rep. of Germany | 123/470 |
| 2233919 | 1/1974 | Fed. Rep. of Germany | 123/470 |
| 687248 | 9/1979 | U.S.S.R. | 123/470 |

*Primary Examiner*—Raymond A. Nelli

*Attorney, Agent, or Firm*—Charles E. Brown

[57] ABSTRACT

This invention relates to a petrol injector protection sheath constructed of thermally insulating material such as rubber, for preventing overheating of said injector.

9 Claims, 1 Drawing Figure

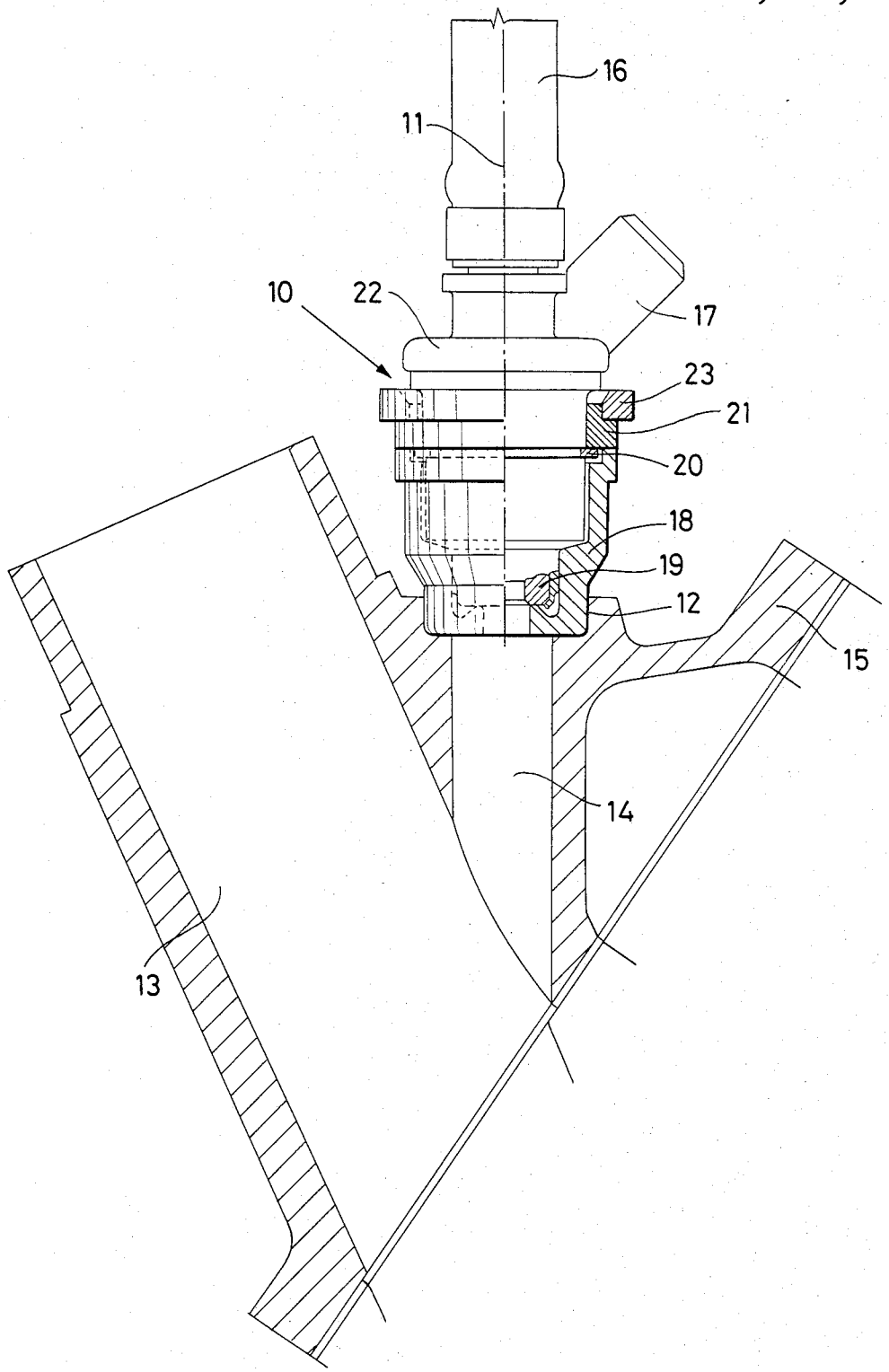
16
11
10
22
17
23
21
20
18
19
12
15
14
13

PETROL INJECTOR PROTECTION SHEATH

In the case of internal combustion engines of the petrol injection type with the injectors disposed in the intake ducts flanged to the cylinder head or in ducts formed in said cylinder head, heat can be transferred to the electrically operated injectors from the duct wall or from the cylinder head by the effect of conduction and radiation, and also by convection by means of the air present in the engine compartment and in said ducts.

If the injectors overheat, partial evaporation of the more volatile fractions of the petrol can occur. The vapour thus formed hinders the discharge of the still liquid petrol from the injection nozzle, especially if the injection pressure is low. Petrol delivery is thus reduced, and can even cease, with the consequence that irregularities and lack of combustion in the engine can occur.

In order to limit heat absorption, currently avaiable injectors are fitted with a plastics protection cap which is mounted over the nozzle support nose and serves to thermally insulate it from the air flowing in the intake duct. Furthermore, these injectors are mounted in the intake ducts by means of rubber rings which perform a sealing function, but which also offer a limited thermal insulation from the wall of the intake duct.

Such injectors are therefore partly insulated from the intake duct wall or cylinder head, and from the air flowing through the intake duct, but they are not insulated from the hot air present in the engine compartment.

During engine operation, the engine compartment is traversed by an air stream due either to aerodynamic ventilation or to forced ventilation, and because of this continuous air change the temperature in its interior is kept within acceptable limits, assuming values which are only slightly higher than the external temperature. The injectors are therefore exposed to a moderate heat flow. Moreover, while the engine is operating, the heat absorbed by the injectors is partly transferred to the petrol which passes through them before being injected into the engine, and the petrol vaporisation temperature is not attained because of this continuous petrol change. However, when the engine stops, the most critical conditions occur for the injectors because the air present in the engine compartment is exposed to the heat emitted by said engine without being able to undergo air change, and only moves conductively from the bottom, where it is at ambient temperature, to the top, where it assumes high temperature.

The injectors, which are located in the highest part of the engine compartment, are therefore immersed in an atmosphere of overheated air, and within a short time reach a temperature close to the temperature of the engine cylinder head.

If the engine is again started before the injectors have cooled down, the discharge from the injection nozzle can be strongly reduced or even nullified because the fresh petrol fed by the feed circuit undergoes strong evaporation inside the injectors due to contact with the overheated body of said injectors coupled with the pressure drop undergone during passage through the injection nozzle. Our research has shown that these operating abnormalities can be obviated by also thermally insulating that portion of the injector body which is exposed to the air present in the engine compartment, and for this purpose we have conceived a protection sheath of a thermally insulating material, preferably rubber, which is a poor heat conductor. The sheath is in the form of a cup with its base wall perforated and its lateral wall completely covering the metal part of the injector body.

As the protection sheath according to the invention is of rubber, it also acts as a seal where the injector is housed in the intake duct wall or cylinder head, so replacing the rubber seal ring which is normally used.

Characteristics and advantages of the invention will be more apparent from an examination of the accompanying FIGURE which shows a preferred embodiment of said invention by way of non-limiting example.

The FIGURE represents a front view of an electrically operated petrol injector, indicated overall by 10, which is shown in partial axial section to one side of the centre plane, indicated by the line 11. The electrically operated injector 10 is mounted in a suitable seat 12 in the wall of an internal combustion engine intake duct 13. The intake duct 13 is represented in axial section, and the FIGURE also shows the small duct 14 through which the petrol injected by the electrically operated injector 10 penetrates into the air drawn in through the duct 13.

The reference numeral 15 indicates the flange of the duct 13 for connection to the engine cylinder head (not shown); 16 indicates the connection pipe through which the electrically operated injector is fed with petrol under pressure from a suitable feed circuit comprising a pump; and 17 indicates the seat of the terminal for connecting the injector solenoid to the electrical supply circuit. A sheath of large-thickness rubber, indicated by 18, is mounted on the injector body. The sheath 18, which is in the form of a cup with its base wall perforated, is provided with a lateral wall which covers the injector body from the nozzle support nose, indicated by 19, to the seat of the split ring 20. A rubber seal ring, indicated by 21, is mounted over the split ring 20 and over the upper edge of the sheath 18, to surround the injector body in proximity to the cap 22, which is generally covered by a plastics or rubber cover. The ring 23 of a support bracket which fixes the injector 10 to the duct 13 is partly visible in the FIGURE.

The body of the injector 10 is therefore completely enclosed by an insulating covering. The rubber sheath 18 is mounted over its lower and central part and also acts as the seal at the seat 12, and the rubber seal ring 21 is mounted over the top part to also perform an insulating function, as does the plastics or rubber cover of the cap 22.

In this manner not only is the transfer of heat by conduction and radiation from the wall of the duct 13 and from the engine cylinder head towards the injector 10 hindered, but also the transfer of heat by convection by the air which surrounds it internally in the duct 14 and externally in the engine compartment.

I claim:

1. A fuel injector of the type having a fitting for attachment to a fuel supply line, an electrical control, a body and a lower nozzle, said fuel injector being improved by heat shielding means including a thick wall heat insulating cup-shaped sheath telescoped entirely over said nozzle and surrounding said body, said sheath including a bottom wall having a hole therethrough for the injection of fuel, a lower part of said sheath including an outer portion of said bottom wall forming combined seating and sealing means for the mounting of said fuel injector within a seat of an engine intake duct.

2. A fuel injector according to claim 1 wherein an upper part of said fuel injector is encased in an insulated cap.

3. A fuel injector according to claim 1 wherein an upper part of said fuel injector is encased in an insulated cap which extends down to a top of said sheath.

4. A fuel injector according to claim 1 together with an insulating ring seated on a top of said sheath and having a seating surface for receiving a support bracket.

5. A fuel injector according to claim 4 wherein there is a pressure receiving shoulder on said fuel injector having an upper surface generally coplanar with the top of said sheath, and said insulating ring being seated on said shoulder for applying a retention force directly on said shoulder in addition to a force applied to the top of said sheath.

6. A fuel injector according to claim 5 wherein said shoulder is defined by a ring.

7. A fuel injector according to claim 4 wherein an upper part of said fuel injector is encased in an insulated cap.

8. A fuel injector according to claim 4 wherein an upper part of said fuel injector is encased in an insulated cap which extends down to a top of said sheath.

9. A fuel injector according to claim 5 wherein an upper part of said fuel injector is encased in an insulated cap which extends down to a top of said sheath.

* * * * *